United States Patent [19]

Yamamoto et al.

[11] Patent Number: 4,811,689

[45] Date of Patent: Mar. 14, 1989

[54] ELECTROSTATIC POWDER COATING APPARATUS

[75] Inventors: Masahiro Yamamoto, Sakura; Mituyosi Kumata, Toyonaka; Katutoshi Kozoe; Tsutomu Itoh, both of Tokyo, all of Japan

[73] Assignee: Onoda Cement Company, Ltd., Yamaguchi, Japan

[21] Appl. No.: 862,036

[22] Filed: May 12, 1986

[30] Foreign Application Priority Data

May 16, 1985 [JP] Japan ..... 60-104800

[51] Int. Cl.[4] ..... B05B 5/02

[52] U.S. Cl. ..... 118/624; 118/630

[58] Field of Search ..... 118/624, 630, 649; 427/26, 33, 27

[56] References Cited

U.S. PATENT DOCUMENTS 2,632,716 3/1953 Starkey ..... 118/624 X
2,773,472 12/1956 Lamm ..... 118/624
2,794,416 6/1957 Shepherd ..... 427/26 X

FOREIGN PATENT DOCUMENTS 213625 10/1956 Australia ..... 427/27
2841395 3/1980 Fed. Rep. of Germany ..... 118/630

OTHER PUBLICATIONS

Sears, F. W. and Zemansky, M. W., *University Physics*, Third Edition, Reading, MA, Addison-Wesley Publishing Company, Inc., 1964, p. 533.

*Primary Examiner*—Evan Lawrence
*Attorney, Agent, or Firm*—Price, Heneveld, Cooper, DeWitt & Litton

[57] ABSTRACT

An electrostatical powder coating method and apparatus therefor, in which an auxiliary electrode is disposed in the vicinity of a desired coating surface of an object to be coated, a gun for performing electrostatically powder coating is directed to the object to be coated and the auxiliary electrode, a DC electric field is formed between the gun, the auxiliary electrode and the object to be coated, the auxiliary electrode is electrically charged to the same polarity as the gun so as to form an auxiliary electric field between the auxiliary electrode and the desired coating surface of the object to be coated whereby a powder coating material is transferred to be applied onto the desired coating surface by the electric field.

4 Claims, 6 Drawing Sheets

ELECTROSTATIC POWDER COATING APPARATUS

BACKGROUND OF THE INVENTION

1. Field of the Invention

The present invention relates to an electrostatically powder coating method and an apparatus therefor, in which a gun for electrostatically powder coating is directed to an object to be coated, a DC electric field is formed in an area including the gun and the object to be coated so that a powder coating material jetted into the DC electric field is transferred and applied onto the object to be coated, and the object is then heated so that the applied coating material is baked on the object.

2. Description of Prior Art

Conventionally, electrostatic powder coating has been performed through the steps of; providing a gun for electrostatically powder coating separated from and directed to an object to be coated; jetting a powder coating material suspending in air from the gun with the simultaneous application of a DC high voltage onto the discharge nozzle of the gun to generate corona discharge; electrically charging the powder coating material by an ionic current from the gun to the object to be coated so that the charged powder coating material is transferred onto the surface of the object to be coated by Coulomb attraction to form a layer of the applied powder coating material thereon; and then heating the object so as to form a film of the powder coating material baked on the surface of the object.

In this case there has been such a disadvantage that the thickness of the powder coating material applied on the surface of the object to be coated varies with the position depending on the intensity of the electric field at the respective position, that is, depending on the shape and position of the object to be coated, so that it is difficult to apply the coating material with a uniform thickness, and that depending on the shape of the object to be coated a Faraday cylinder effect makes the so-called creeping and penetrating properties poor to thereby lower the efficiency in coating.

SUMMARY OF THE INVENTION

It is therefore an object of the present invention to solve the problem of the unevenness in film thickness depending on the shape and position of the object to be coated and to make it possible to apply the coating material onto a desired surface portion on the object to be coated.

It is another object of the present invention to improve the creeping and penetrating properties on the surface of the object to be coated to thereby heighten the efficiency in coating.

To attain the foregoing objects, according to an aspect of the present invention, the electrostatically powder coating method comprising the steps of directing a gun for performing electrostatically powder coating toward an object to be coated, and forming a DC electric field between the gun and the object so as to coat the object with a powder coating material jetted into the electric field, is featured in that the method further comprises the steps of providing an auxiliary electrode in the vicinity of a desired coating surface of the object to be coated, and electrically charging the auxiliary electrode in the same polarity as the gun to thereby form an auxiliary electric field between the auxiliary electrode and the desired coating surface of the object to be coated so that a part of the powder coating material is applied onto the desired coating surface by the auxiliary electric field.

For the direct use for executing the above-mentioned method, according to another aspect of the present invention, the electrostatically powder coating apparatus comprising an electrostatically powder coating gun directed to an object to be coated, and a DC high voltage source connected between the gun and the object, is featured in that the apparatus further comprises an auxiliary electrode provided in the vicinity of a desired coating surface of the object to be coated, the auxiliary electrode being charged in the same polarity as the gun.

When a DC high voltage is applied to the electrostatically powder coating gun, an ionic current flows between the gun and the object to be coated and an electric field is formed thereat, so that the powder coating material jetted out of the gun is charged and transferred to the surface of the object to be coated owing to the action of the electric field.

At the same time, a part of the above-mentioned charged powder coating material is caused to move onto the desired coating surface of the object to be coated by the electric field formed between the auxiliary electrode and the desired coating surface of the object to be coated, so that the part of the powder coating material locally adheres on the object to be coated.

The auxiliary electrode is then removed from the object coated with the powder coating material, and in this state, the coated object is heated so as to bake the powder coating, material to stick onto the surface of the object while preventing the powder coating material attached on the auxiliary electrode from being baked thereon.

Thus, according to the present invention, it is possible to perform coating onto even such a portion where it has been difficult for the conventional means to make coating owing to the characteristics of the shape of the object to be coated.

That is, according to the present invention, owing to the provision of the auxiliary electrode in the vicinity of the desired coating surface, it is made possible to locally form an auxiliary electric field with respect to the desired coating surface so that the charged powder coating material can be transferred by the auxiliary electric field onto the desired coating surface.

Accordingly, the desired coating surface can be coated to a uniform thickness regardless of the shape of the object to be coated so that it is possible to improve the creeping and penetrating properties, resulting in the improvement in coating efficiency.

These and other objects, features, advantages and uses of the present invention will be more apparent, when considered with the accompanying drawings.

DETAILED DESCRIPTION OF THE PREFERRED EMBODIMENTS

Figure 1:
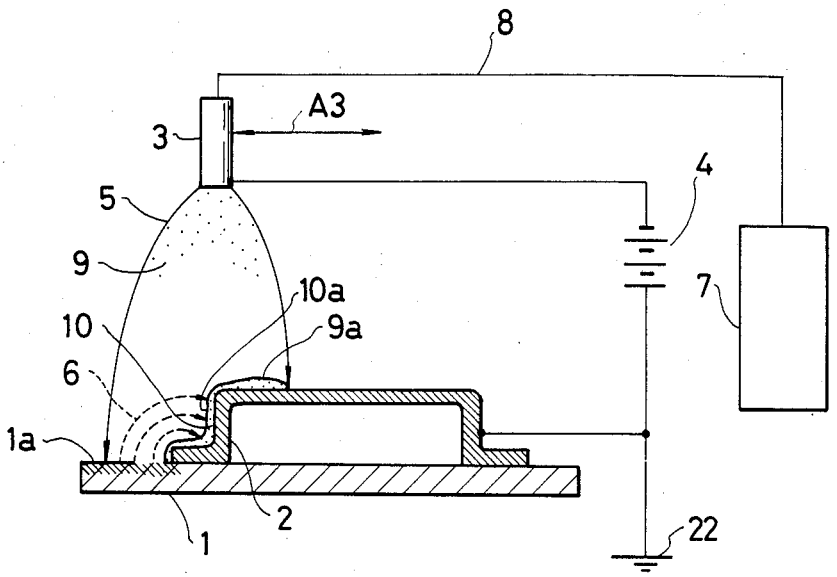
FIG. 1 is a cross-section showing an embodiment of the present invention.

Referring to the drawings, embodiments of the present invention will be described hereunder.

FIG. 1 shows an embodiment of the present invention in which an object to be coated 2 having a desired shape is mounted on a planar auxiliary electrode 1 made of an insulating material such as a plastic or a ceramic material. The object to be coated 2 is connected to an earth point 22. A gun 3 for performing electrostatic powder coating is directed to the object to be coated 2 and the auxiliary electrode 1 and arranged to be movable in the direction indicated by an arrow A3. A DC high voltage source 4 is connected with the gun 3 so as to form an electric field 5 between the gun 3 and the object to be coated 2 as well as an auxiliary electric field 6 between the gun 3 and the auxiliary electrode 1.

The gun 3 is connected with a powder coating material supply source 7 through a transporting pipe 8 so that a powder coating material 9 is jetted out of the gun 3 through a discharge nozzle thereof into the electric field 5.

At that time, the powder coating material 9 is electrically charged with an ionic current generated at the discharge nozzle of the gun 3 and moved onto the surface of the object to be coated 2 to thereby form a powder layer 9*a* thereat.

A surface 1*a* of the auxiliary electrode 1 is electrically charged with the ionic current of the electric field 5 in the same polarity as the gun 3 to thereby form the auxiliary electric field 6 between the surface la and a desired coating surface 10 of the object to be coated 2, so that the powder coating material 9 is transferred by the auxiliary electric field 6 toward the desired coating surface 10 to thereby coat the desired coating surface 10 with a desired powder layer 10*a*.

In this case, it is difficult to make the powder coating material 9 adhere completely on the desired coating surface 10 only by the electric field 5 in view of the characteristics in shape of the object to be coated 2. The auxiliary electric field 6, however, may help the electric field 5 to completely perform the coating on the desired coating surface 10 regardless of the shape of the object to be coated 2.

Figure 2:
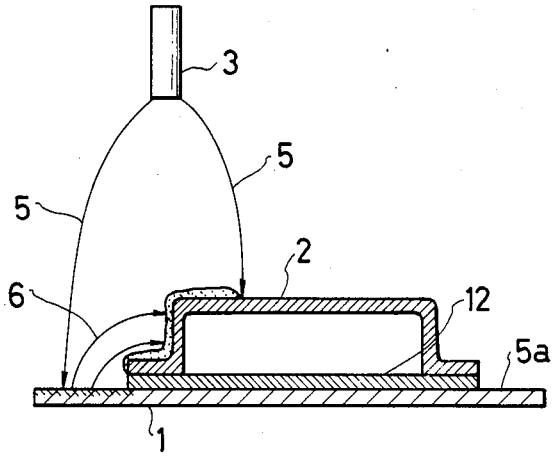
FIG. 2 is a cross-section showing another embodiment of the present invention.

The auxiliary electrode 1 is not limited to an electric insulator but may be made of a semiconductor or a conductor as shown in another embodiment in FIG. 2. In this case, it is necessary to provide an insulator 12 between the object to be coated 2 and the auxiliary electrode 1.

Figure 3:
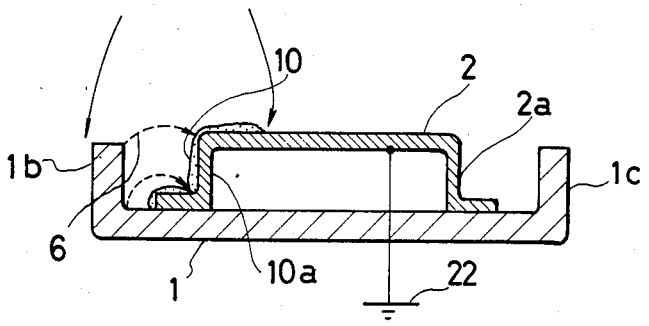
FIG. 3 is a cross-section showing a modification of the embodiment of FIG. 1 which is partly changed.

Further, although illustrated in a planar shape, the auxiliary electrode 1 may be made to have a suitable shape if desired. For example, the auxiliary electrode 1 may be upward bent at the left and right end portions as shown in FIG. 3, which is a modification of FIG. 1, so as to make the auxiliary electrode 1 closer to the desired coating surface 10. In this case, the electric field 6 may be made uniform with respect to the desired coating surface 10 so that the desired coating layer 10*a* may be made to have a uniform thickness.

Figure 4:
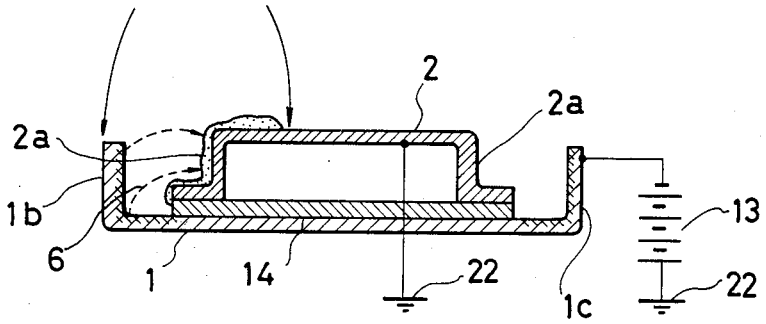
FIG. 4 is a cross-section showing a modification of the embodiment of FIG. 2 which is partly changed.

FIG. 4 shows a further embodiment in which the auxiliary electrode 1 is made of an electrically conductive material unlike the embodiment of FIG. 3 in which the auxiliary electrode 1 is made of an insulating material. An insulator 14 is provided between the object to be coated 2 and the auxiliary electrode 1. The auxiliary electrode 1 is connected with the DC high voltage source 13. A high voltage of the same polarity as the gun (omitted in the drawing) is used so as to form the auxiliary electric field 6 between the auxiliary electrode 1 and the desired coating surface 10.

Figure 5:
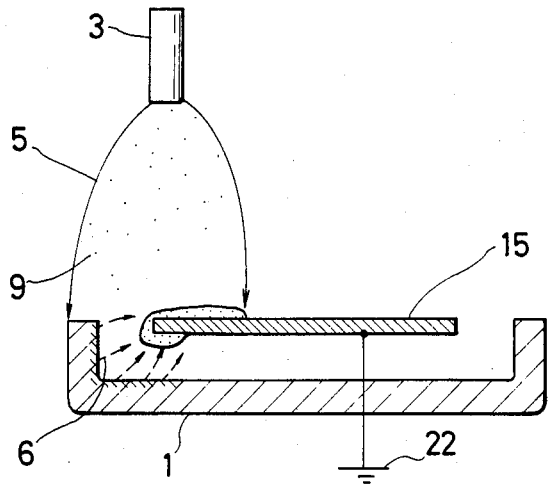
FIG. 5 is a cross-section showing a modification of the embodiment of FIG. 3 which is partly changed.

FIG. 5 shows a modification of the embodiment of FIG. 3 in which the object to be coated 2 is replaced by a different object to be coated 15 having a planar shape. If coating is performed under the condition that the object to be coated 15 is slightly separated from the auxiliary electrode 1, the auxiliary field 6 is formed even to the rear of the object to be coated 15 in addition to the electric field 5 between the object to be coated 15 and the gun 3, so that the electrically charged powder coating material 9 may adhere even onto the rear portion of the object to be coated 15, thereby improving the creeping and penetrating properties of the powder coating material 9 on the surface of the object to be coated.

Figure 6:
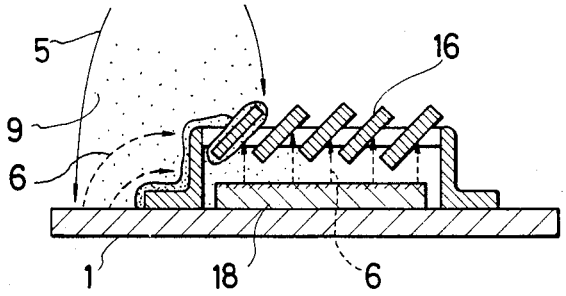
FIG. 6 is a cross-section showing still another embodiment of the present invention.
Figure 7:
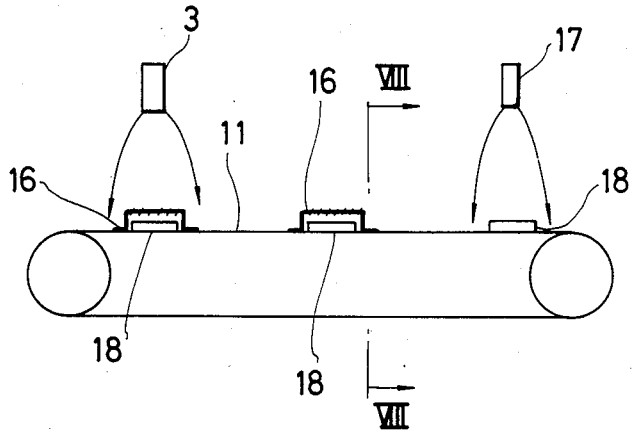
FIG. 7 is a side view of a further embodiment in which the embodiment of FIG. 6 is continuously performed.
Figure 8:
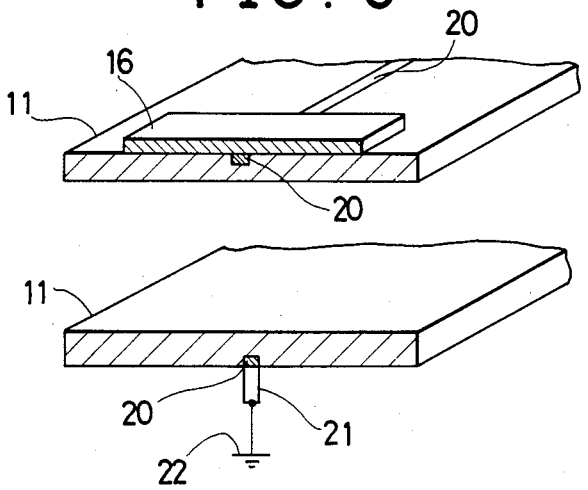
FIG. 8 is an enlarged perspective view when viewed from the section taken along the line VIII—VIII of FIG. 7.

Although the auxiliary electrode 1 described in the foregoing embodiments is electrically charged by the gun 3 with an ionic current when coating is carried out, the auxiliary electrode 1 may be electrically charged in advance before electrostatic coating is performed. Fig. 6 shows still another embodiment in which an auxiliary electrode 18 is previously charged. That is, for example, in the case of coating a louver-like object to be coated 16, the precharged auxiliary electrode 18 is put inside the object to be coated 16 so that the auxiliary electric field 6 is formed between the auxiliary electrode 18 and the inner surface of the object to be coated 16 so as to coat the inner surface with the powder coating material FIG. 7 is a side view of a further embodiment which is intended to perform the embodiment of FIG. 6 more efficiently by providing the auxiliary electrode 1 in the form of an endless belt conveyor 11. In this case, the auxiliary electrode 18 to be electrically precharged is mounted on the belt conveyer 11 at one end portion thereof and electrically charged by a precharger 17. When the conveyer 11 has been moved to the next position, the object to be coated 16 is put over the precharged auxiliary electrode 18 and then coated with the powder coating material by the gun 3 during the movement to the other side of the conveyer 11. Thereafter, the object to be coated 16 is taken off together with the auxiliary electrode 18 from the conveyer 11 at the other end portion thereof, and separated from the auxiliary electrode 18. Then, only the object to be coated 16 is heated so as to bake the powder coating material applied on the surface of the object to be coated 16 to thereby make the powder coating material fixedly adhere on the surface. In this case, it is necessary to earth the object to be coated 16. The earthing may be performed in such a manner as shown in FIG. 8. That is, a conductor 20 is exposed on the upper surface of the belt conveyer 11 and the object to be coated 16 is mounted so as to be in contact with the conductor 20. The conductor 20 is arranged to be in slidable contact with a contact member 21 which is connected to the earth point 22, so that the object to be coated 16 is earthed through the conductor 20 and the contact member 21.

Figure 9:
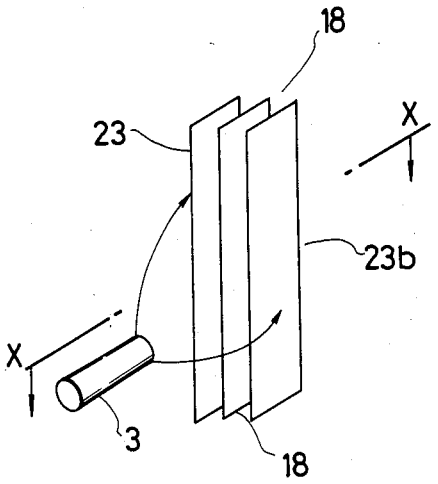
FIG. 9 is a perspective view of a further embodiment of the present invention.
Figure 10:
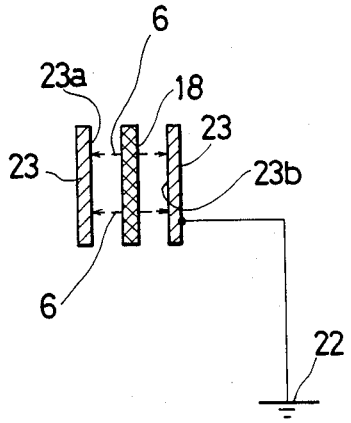
FIG. 10 is an enlarged cross-section along the line VIII—VIII of FIG. 9.
Figure 11:
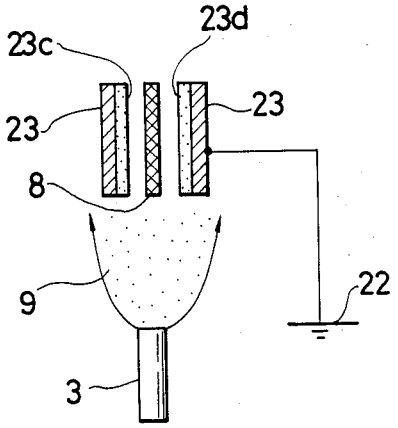
FIG. 11 is an enlarged cross-section showing another state of the embodiment of FIG. 10.

FIGS. 9 through 11 show another embodiment in which an object to be coated 23 constituted by two parallel plates is coated at mutually opposing faces 23*a* and 23*b* thereof by using the precharged auxiliary electrode 18. In this case, the coating operation is carried out by the gun 3 under the condition that the auxiliary electrode 18 is disposed between the mutually opposing surfaces 23*a* and 23*b* as shown in FIGS. 9 through 11. First, only the auxiliary electrode 18 is put at a position separate from the object to be coated 23 and electrically precharged thereat. Then, the precharged auxiliary electrode 18 is disposed between the mutually opposing surfaces 23*a* and 23*b* as shown in FIG. 10, and the powder coating material is jetted out of the gun 3 as shown in FIG. 11 so as to form powder layers 23*c* and 23*d* respectively on the mutually opposing surfaces 23*a* and 23*b* of the object to be coated 23.

Figure 12:
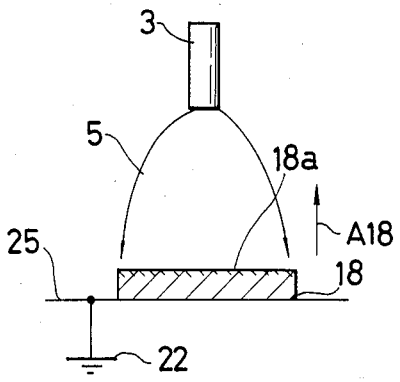
FIG. 12 is a sectional front view showing a main part of a still further embodiment of the present invention.
Figure 13:
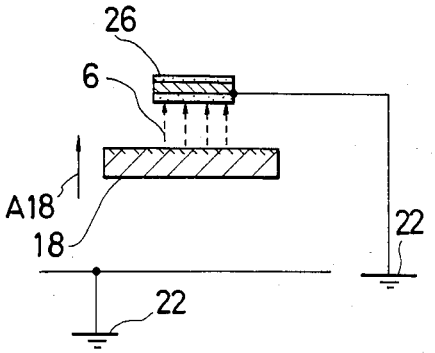
FIG. 13 is a cross-section showing another state of the embodiment of FIG. 12.

Any means may be employed to precharge the auxiliary electrode in the foregoing embodiments so long as it can charge the auxiliary electrode. For example, as shown in an embodiment in FIG. 12, the auxiliary electrode 18 is put on an earthing surface 25 connected to the earth point 22 and the surface 18 thereof is charged with a predetermined electric field intensity by corona discharge from the gun 3. Then, the auxiliary electrode 18 is separated from the earthing surface 25 in the direction of an arrow A18 as shown in FIG. 13. Thus, the electrostatic capacity between the auxiliary electrode 18 and the earthing surface 25 can be reduced and the surface voltage of the auxiliary electrode 18 can be made high. In this embodiment, it is possible to increase the intensity of the auxiliary electric field 6 between the object to be coated 26 and the auxiliary electrode 18 so as to improve the adhesion of the powder coating material onto the object to be coated 26.

Figure 14:
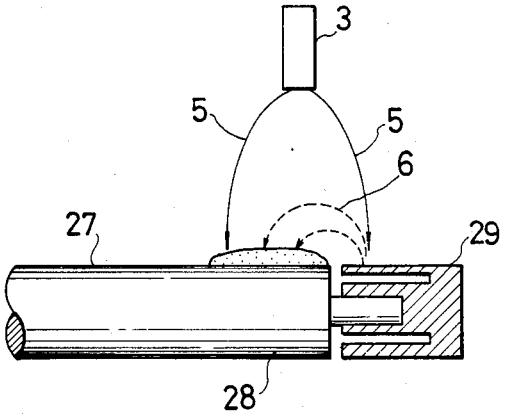
FIG. 14 is a sectional front view showing a main part of a further embodiment of the present invention.

FIG. 14 shows a further embodiment in which a roll-like object to be coated 27 is coated with a powder coating material. Generally, the surface of such a roll-like object to be coated 27 is insufficiently coated at its end portion 28. In this embodiment, to perform coating at the end portion 28, an auxiliary electrode 29 having a roll-like shape is provided at the end portion 28 as an extension of the end portion 28, and a high voltage is applied to the gun 3 so that the auxiliary electric field 6 is formed from the auxiliary electrode 29 toward the end portion 28 in addition to the electric field 5 from the gun 3, enabling the end portion 28 to be coated with the powder coating material with the same thickness as that in the other portions of the object to be coated 27.

What is claimed is:

1. In an electrostatic powder coating apparatus having an electrostatic powder coating gun directed to an object to be coated, and a DC high voltage source connected between said gun and said object, said DC high voltage source forming a DC electric field between said gun and an object to be coated, the improvement comprising an auxiliary electrode provided in the vicinity of a desired coating surface of said object to produce an auxiliary electric field, whereby said auxiliary electrode is charged with the ionic current generated by said DC electric field in the same polarity as said gun, and said auxiliary electrode is provided on a surface of a belt conveyor supporting said object and facing the direction of said gun.

2. An electrostatic powder coating apparatus according to claim 1 in which an earthing surface is provided on said surface of said belt conveyor whereby said earthing surface will be removably in contact with an object to be coated that is removably placed on said surface of said belt.

3. In an electrostatic powder coating apparatus having an electrostatic powder coating gun directed to an object to be coated, and an DC high voltage source connected between said gun and said object, said DC high voltage source forming a DC electric field between said gun and an object to be coated, the improvement comprising an auxiliary electrode provided in the vicinity of a desired coating surface of said object to produce an auxiliary electric field, whereby said auxiliary electrode is charged with the ionic current generated by said DC electric field in the same polarity as said gun, and said auxiliary electrode is formed to be belt-like in an endless manner.

4. An electrostatic powder coating apparatus, comprising an electrostatic powder coating gun directed to an object to be coated, and a DC high voltage source connected between said gun and said object, the improvement further comprising an auxiliary electrode provided in the vicinity of a desired coating surface of said object, said auxiliary electrode being charged in the same polarity as said gun, wherein said auxiliary electrode is formed to be belt-like in an endless manner and further wherein said endless belt-like auxiliary electrode is formed with a longitudinally extending linear earthing surface.

* * * * *

UNITED STATES PATENT AND TRADEMARK OFFICE

CERTIFICATE OF CORRECTION

PATENT NO. : 4,811,689

DATED : March 14, 1989

INVENTOR(S) : Masahiro Yamamoto et al.

It is certified that error appears in the above-identified patent and that said Letters Patent is hereby corrected as shown below:

Title Page

Abstract of the Disclosure, line 1:

"electrostatical" should be -- electrostatic --

Column 3, line 12:

"VIII-VIII" should be -- X-X --

Column 3, line 53:

"surface la" (printed as a lower case "ℓ")

should be -- surface 1a -- (printed as the numeral "1"

Column 6, line 31:

"an" should be -- a --

Signed and Sealed this

Twenty-fourth Day of July, 1990

*Attest:*

*Attesting Officer*

HARRY F. MANBECK, JR.

*Commissioner of Patents and Trademarks*